US008978191B2

(12) United States Patent
Yu

(10) Patent No.: US 8,978,191 B2
(45) Date of Patent: Mar. 17, 2015

(54) MOP STRUCTURE

(76) Inventor: Tsung-Mou Yu, Taipei County (TW)

( * ) Notice: Subject to any disclaimer, the term of this patent is extended or adjusted under 35 U.S.C. 154(b) by 230 days.

(21) Appl. No.: 13/699,596

(22) PCT Filed: Apr. 1, 2011

(86) PCT No.: PCT/CN2011/072386

§ 371 (c)(1),
(2), (4) Date: Nov. 21, 2012

(87) PCT Pub. No.: WO2012/109812

PCT Pub. Date: Aug. 23, 2012

(65) Prior Publication Data

US 2013/0067673 A1 Mar. 21, 2013

(30) Foreign Application Priority Data

Feb. 16, 2011 (CN) ..... 2011 2 0040988 U

(51) Int. Cl.

| | |
|---|---|
| ***A47L 13/258*** | (2006.01) |
| ***A47L 13/59*** | (2006.01) |
| ***A47L 13/20*** | (2006.01) |
| *A47L 13/24* | (2006.01) |

(52) U.S. Cl.

CPC ..... *A47L 13/20* (2013.01); *A47L 13/24* (2013.01); *A47L 13/258* (2013.01); *A47L 13/59* (2013.01)

USPC ..... 15/228

(58) Field of Classification Search

CPC ..... A47L 13/253; A47L 13/258

USPC ..... 15/119.1, 119.2, 228, 229.1, 147.1, 15/147.2, 149, 260, 263

See application file for complete search history.

(56) References Cited

U.S. PATENT DOCUMENTS 4,845,800 A 7/1989 Pederson et al.

FOREIGN PATENT DOCUMENTS

| | | | | |
|---|---|---|---|---|
| CN | 201123795 Y | | 10/2008 | |
| CN | 201208241 Y | | 3/2009 | |
| CN | 201290654 Y | | 8/2009 | |
| CN | 201375488 Y | | 1/2010 | |
| CN | 201701170 U | | 1/2011 | |
| CN | 201987481 U | | 9/2011 | |
| WO | WO 03056997 A1 | * | 7/2003 | ..... A47L 13/44 |
| WO | WO2005048805 A1 | | 6/2005 | |

OTHER PUBLICATIONS

WO03056997 (machine translation), 2003.*
WO03056997 (Abstract), 2003.*

* cited by examiner

*Primary Examiner* — Mark Spisich
*Assistant Examiner* — Andrew A Horton
(74) *Attorney, Agent, or Firm* — Muncy, Geissler, Olds & Lowe, P.C.

(57) ABSTRACT

A mop structure is provided, which comprises a shaft body, a rotary disc and a coupling assembly. The rotary disc has a rotary disc hole. The coupling assembly is inserted through the rotary disc hole and connects the shaft body with the rotary disc. In addition, the rotary disc is formed with an extending part at two ends corresponding to the rotary disc hole respectively, and the extending parts are bendable with respect to the rotary disc. Thereby, bending the extending parts can make it further convenient to perform the dewatering operation to achieve the cleaning and dewatering efficacy.

8 Claims, 17 Drawing Sheets

103

MOP STRUCTURE

BACKGROUND OF THE INVENTION

1. Technical Field

The present invention relates to a household washing or cleaning appliance, and more particularly, to an appliance for cleaning floors, carpets, furniture, walls and wall coverings.

2. Description of Related Art

In conventional flat mop structures, a cleaning part is fixed to a flat mount of the mop through adhesion or clamping, and the cleaning part is used to wipe a floor to be cleaned so that dirt on the floor is transferred to the cleaning part, thus achieving the purpose of cleaning the floor. For example, although mop products currently available in the market generally adopt a cleaning part of a flat structure in order to obtain a large cleaning area, the cleaning part is only applicable to dry-type or electrostatic-type cleaning part structure, and this not only wastes the resources but also increases the burden of environmental protection. Additionally, for some obstinate dirt, a wet cleaning part must be used to wipe it in order to obtain a thorough cleaning effect. However, the flat mop structures currently available still cannot be wrung through a dewatering process but have to be wrung by hands, which is very inconvenient and doesn't look nice in public places. As another example, a flat foam mop such as is shown in the prior art Taiwan Patent Taiwan Patent No. M357951 issued in Dec. 12, 2008, entitled "Flat Foam Mop Having an Improved Structure" comprises a base plate, a handle, an outer tube, a middle tube, an inner tube, a main shaft, a main shaft head, a first linking part, a second linking part and a third linking part. The aforesaid components are linked together by means of a fixing pin, a plurality of connecting components, a plurality of pivoting shafts and an elastic component to accomplish the dewatering purpose through wringing. Although this can solve the problem of dewatering the cleaning part through wringing, there are still some problems. For example, the components required are too many and complex, and must be interlinked by means of a plurality of linking parts. This increases the material cost and manufacturing cost and makes the manufacturing and assembling processes relatively complex, which the cost is ineffective.

Accordingly, an urgent need exists in the art to make improvements on the aforesaid conventional flat mop structures so that they can be used by users more conveniently and manufactured at the lowest cost.

BRIEF SUMMARY OF THE INVENTION

To overcome the aforesaid shortcomings, the present invention provides a mop structure, which comprises a shaft body, a rotary disc and a coupling assembly. The rotary disc has a rotary disc hole. The coupling assembly is inserted through the rotary disc hole and connects the shaft body with the rotary disc. The rotary disc is formed with an extending part at two ends corresponding to the rotary disc hole respectively, and the extending parts are bendable with respect to the rotary disc. Thereby, bending the extending parts makes it convenient to perform the dewatering operation. In this way, the purpose of dewatering the mop can be achieved and the shortcoming of the conventional flat mop that the cleaning and dewatering processes cannot be performed at the same time is overcome.

Preferably, each of the extending parts further has at least one first connecting part, the rotary disc further has at least one second connecting part disposed corresponding to the at least one first connecting part, and the extending parts are coupled to the rotary disc by means of the at least one first connecting part and the at least one second connecting part.

Preferably, the rotary disc is further provided with at least one positioning strip near the at least one second connecting part.

Preferably, the mop structure further comprises a pair of elongated parts coupled with the extending parts respectively.

Preferably, each of the extending parts has a third connecting part, each of the elongated parts further comprises a fourth connecting part, the third connecting parts and the fourth connecting parts are disposed in one-to-one correspondence, and the extending parts are coupled to the elongated parts by means of the third connecting parts and the fourth connecting parts respectively.

Preferably, the mop structure further comprises a cleaning appliance disposed at a bottom portions of the rotary disc, the extending parts and the elongated parts.

Preferably, the cleaning appliance has first joining parts, each of the extending parts has a second joining part, and the first joining parts and the second joining parts are joined with each other.

Preferably, the cleaning appliance has first joining parts, each of the elongated parts has a third joining part, and the first joining parts and the third joining parts are joined with each other.

Accordingly, the primary objective of the present invention is to provide a mop structure, in which a rotary disc is formed with an extending part at two ends corresponding to the rotary disc hole respectively and the extending parts are bendable with respect to the rotary disc. The extending parts that are bent can be further coupled to a dewatering tub for purpose of cleaning and dewatering, and this makes wringing of the mop structure more convenient and nice-looking as compared to the hand wringing. Moreover, because it is convenient to clean and dewater the cleaning part, the mop structure can save resources and ease the burden of environmental protection as compared to disposable mop paper or disposable electrostatic cloth available in the market.

Another objective of the present invention is to provide a mop structure. The cleaning part of the structure can cooperate with the dewatering tub for dewatering purpose, which is simple in structure and requirement of the simple components. Therefore, the material cost and the manufacturing cost can be reduced, and manufacturing of the mop structure is made convenient.

In addition, the present invention provides a mop structure, which comprises a shaft body, a rotary disc and a coupling assembly. The rotary disc has a rotary disc hole. The coupling assembly is inserted through the rotary disc hole and connects the shaft body with the rotary disc. The rotary disc is further provided with a cleaning seat, the cleaning seat comprises a joining disc and extending parts extending from two ends of the joining disc respectively, and the extending parts are bendable with respect to the joining disc. Thereby, the cleaning part can be movably detached from the joining disc, which makes the application scope thereof wider; and bending the extending parts makes it convenient to further perform the dewatering operation for purpose of dewatering the mop, and this overcomes the shortcoming of the conventional flat mop that the cleaning and dewatering processes cannot be performed at the same time.

Preferably, each of the extending parts further has at least one first connecting part, the joining disc further has at least one second connecting part disposed corresponding to the at least one first connecting part, and the extending parts are pivoted to the rotary disc by means of a pivot.

Preferably, the rotary disc is further provided with at least one positioning strip at the bottom thereof near the at least one second connecting part.

Preferably, the mop structure further comprises a pair of elongated parts coupled with the extending parts respectively.

Preferably, each of the extending parts has a third connecting part, each of the elongated parts further comprises a fourth connecting part, the third connecting parts and the fourth connecting parts are disposed in one-to-one correspondence, and the extending parts are coupled to the elongated parts by means of the third connecting parts and the fourth connecting parts respectively.

Preferably, the mop structure further comprises a cleaning appliance disposed at bottom portions of the joining disc, the extending parts and the elongated parts.

Preferably, the cleaning appliance has first joining parts, each of the extending parts has a second joining part, and the first joining parts and the second joining parts are joined with each other.

Preferably, the cleaning appliance has first joining parts, each of the elongated parts has a third joining part, and the first joining parts and the third joining parts are joined with each other.

Accordingly, the primary objective of the present invention is to provide a mop structure, in which a rotary disc is formed with an extending part at two ends corresponding to the rotary disc hole respectively and the extending parts are bendable with respect to the rotary disc. The extending parts that are bent can be further coupled to a dewatering tub for purpose of cleaning and dewatering, and this makes wringing of the mop structure more convenient and nice-looking as compared to hand wringing. Moreover, because it is convenient to clean and dewater the cleaning part, the mop structure can save resources and ease the burden of environmental protection as compared to disposable mop paper or disposable electrostatic cloth available in the market.

Another objective of the present invention is to provide a mop structure. The cleaning part of the structure can be used with the dewatering tub for dewatering purpose, is simple in structure and requirement of simple components. Therefore, the material cost and the manufacturing cost can be reduced, and manufacturing of the mop structure is made convenient.

DETAILED DESCRIPTION OF THE EMBODIMENT OF THE INVENTION

The present invention discloses a mop structure, and the rotation dewatering principle adopted therein has been already known by those of ordinary skill in the art and, thus, will not be further detailed in the following description. Meanwhile, it shall be firstly stated that, the attached drawings to which the following description is made with reference are intended to express meanings related to characteristics of the present invention, and are not and also do not need to be depicted completely in accordance with the actual conditions.

Figure 1A:
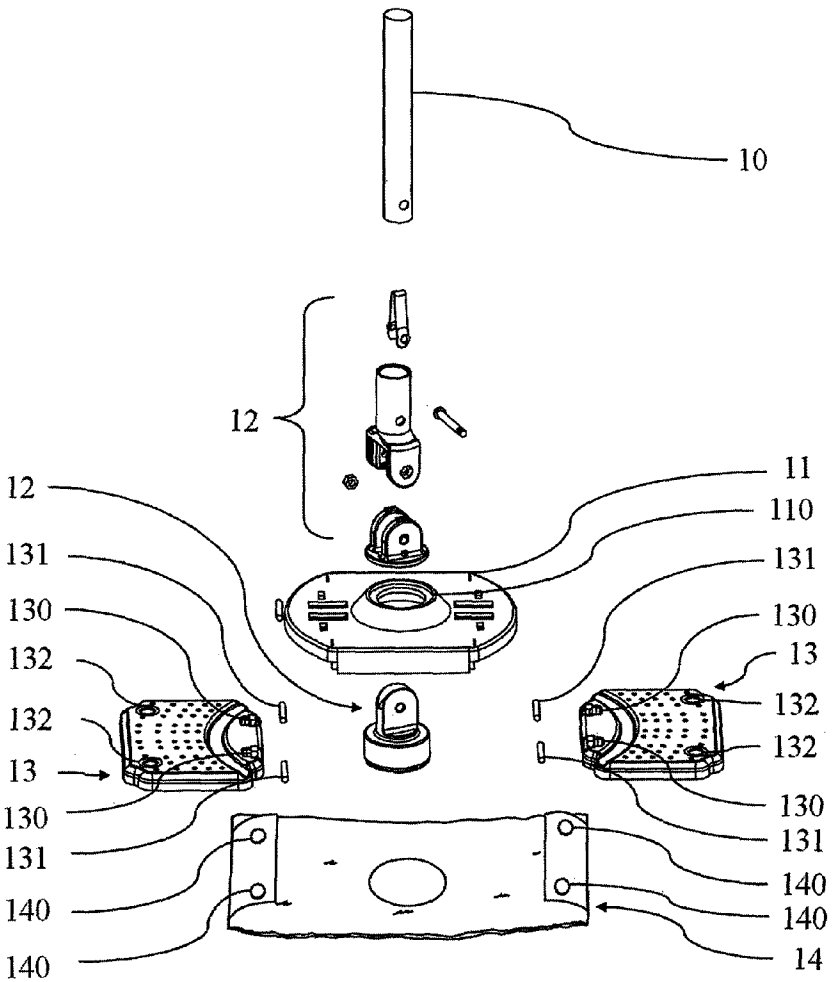
FIG. 1A is an exploded front view illustrating a first preferred embodiment of the present invention.
Figure 1B:
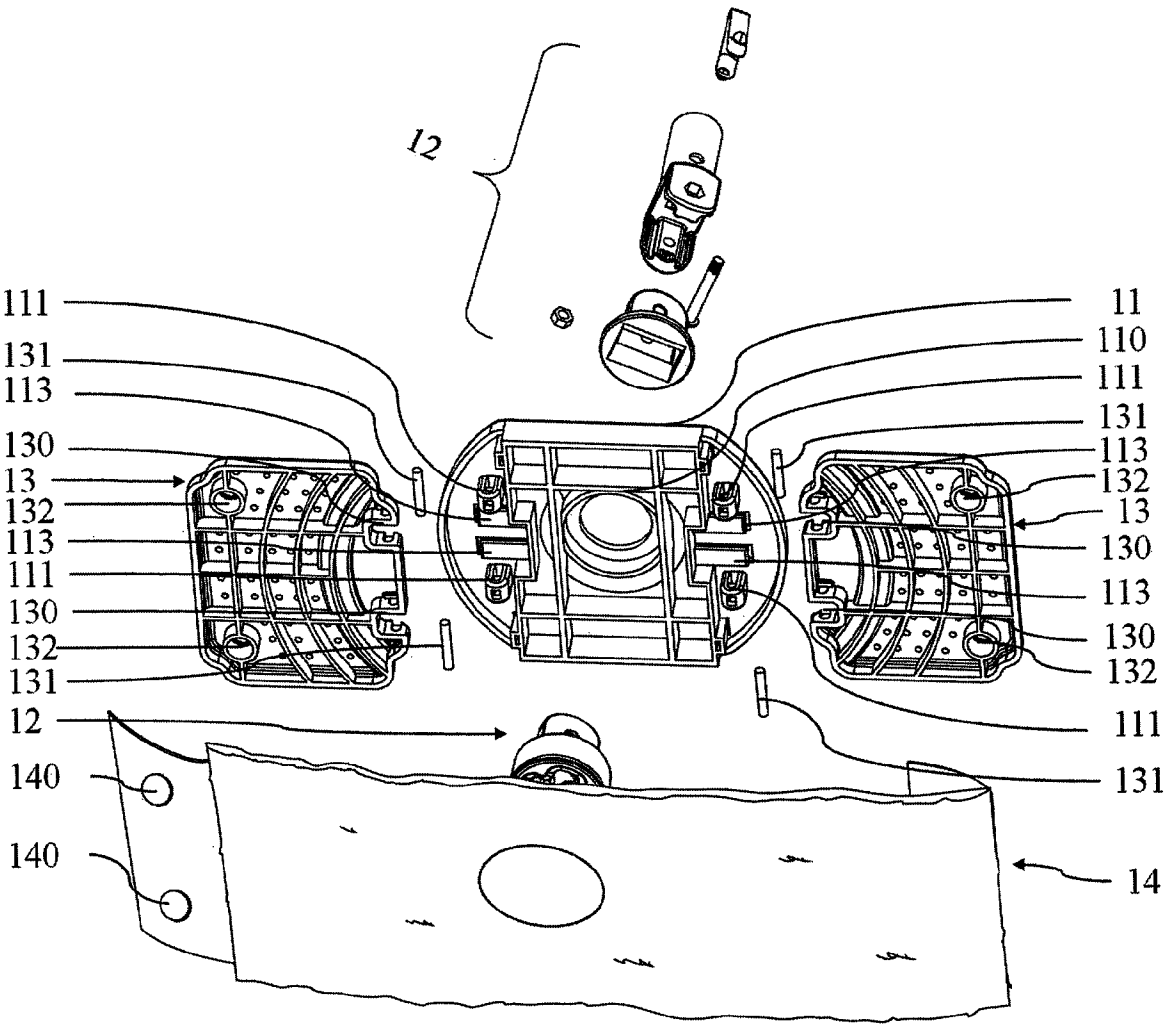
FIG. 1B is an exploded bottom view illustrating the first preferred embodiment of the present invention.
Figure 1C:
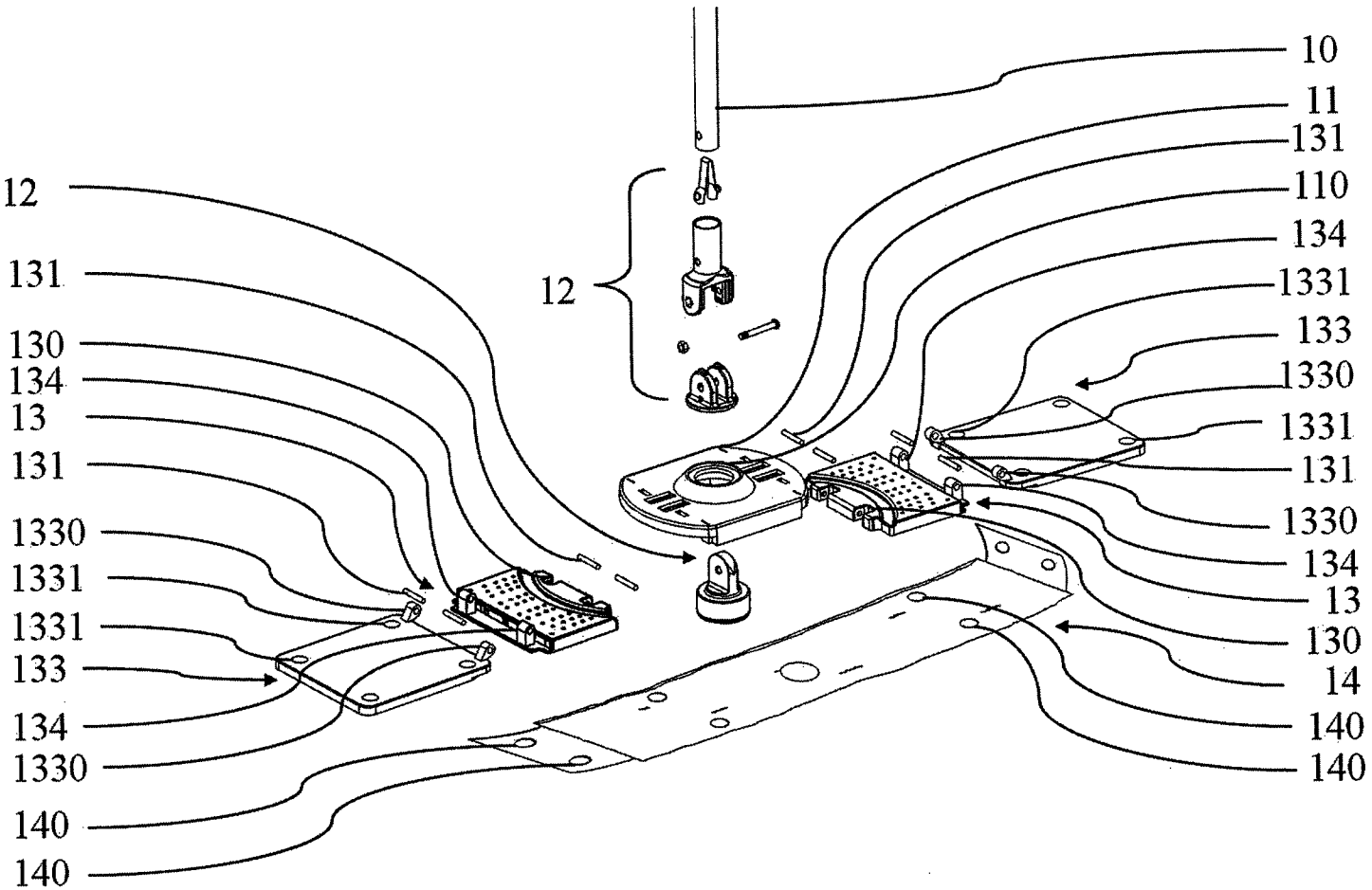
FIG. 1C is another exploded bottom view illustrating the first preferred embodiment of the present invention.

Referring to FIG. 1A firstly, there is shown a mop structure according to a first preferred embodiment of the present invention. This embodiment mainly comprises a shaft body 10, a rotary disc 11 and a coupling assembly 12. The shaft body 10 can be held by a user with his hands to perform a cleaning operation. The rotary disc 11 has a rotary disc hole 110. The coupling assembly 12 is inserted through the rotary disc hole 110 and functions to connect the shaft body 10 with the rotary disc 11. The rotary disc 11 is formed with an extending part 13 at two ends corresponding to the rotary disc hole 110 respectively, and the extending parts 13 are bendable vertically downwards or upwards with respect to the rotary disc 11. Each of the extending parts 13 further has at least one first connecting part 130, and the rotary disc 11 further has at least one second connecting part 111 (as shown in FIG. 1B). The at least one first connecting part 130 of each of the extending parts 13 is disposed corresponding to the at least one second connecting part 111 of the rotary disc 11. Each of the extending parts 13 is pivoted to the rotary disc 11 via a pivot 131 by means of the at least one first connecting part 130 and the at least one second connecting part 111. A positioning strip 113 is further disposed near the at least one second connecting part 111, and there may be one or more positioning strips 113. The positioning strip 113 is used to have the extending parts 13 positioned in a vertical or horizontal status duly when the extending parts 13 are bent vertically downwards or upwards or bent horizontally with respect to the rotary disc 11 so that it is more convenient for operating the mop structure. Referring to FIG. 1A and FIG. 1C, the extending parts 13 can also be coupled with the elongated parts 133 respectively. Each of the extending parts 13 has a third connecting part 134, and each of the elongated parts 133 further comprises a fourth connecting part 1330, with the third connecting parts 134 and the fourth connecting parts 1330 being disposed in one-to-one correspondence. The extending parts 13 are coupled to the elongated parts 133 by means of the third connecting parts 134 and the fourth connecting parts 1330 respectively. This embodiment further comprises a cleaning appliance 14 disposed at bottom portions of the rotary disc 11, the extending parts 13 and the elongated parts 133. The cleaning appliance 14 has first joining parts 140, each of the extending parts 13 has a second joining part 132, and each of the elongated parts 133 has a third joining part 1331. By joining the first joining parts 140 with the second joining parts 132 and the third joining parts 1331, the cleaning appliance 14 can be assembled with the extending parts 13 and the elongated parts 133. The first joining parts 140 and the second joining parts 132 as well as the third joining parts 1331 may be designed as joining knobs and joining holes respectively, or may be joined with each other by means of a magic tape, and the present invention has no limitations herein. Further, the cleaning appliance 14 may have an elastically retractable band structure extending therefrom; and after the cleaning appliance 14 is joined with the extending parts 13 and the elongated parts 133, the extending parts 13 and the elongated parts 133 are bound by the elastically retractable band so that the cleaning appliance 14 is joined with the extending parts 13 and the elongated parts 133 more stably.

Figure 2A:
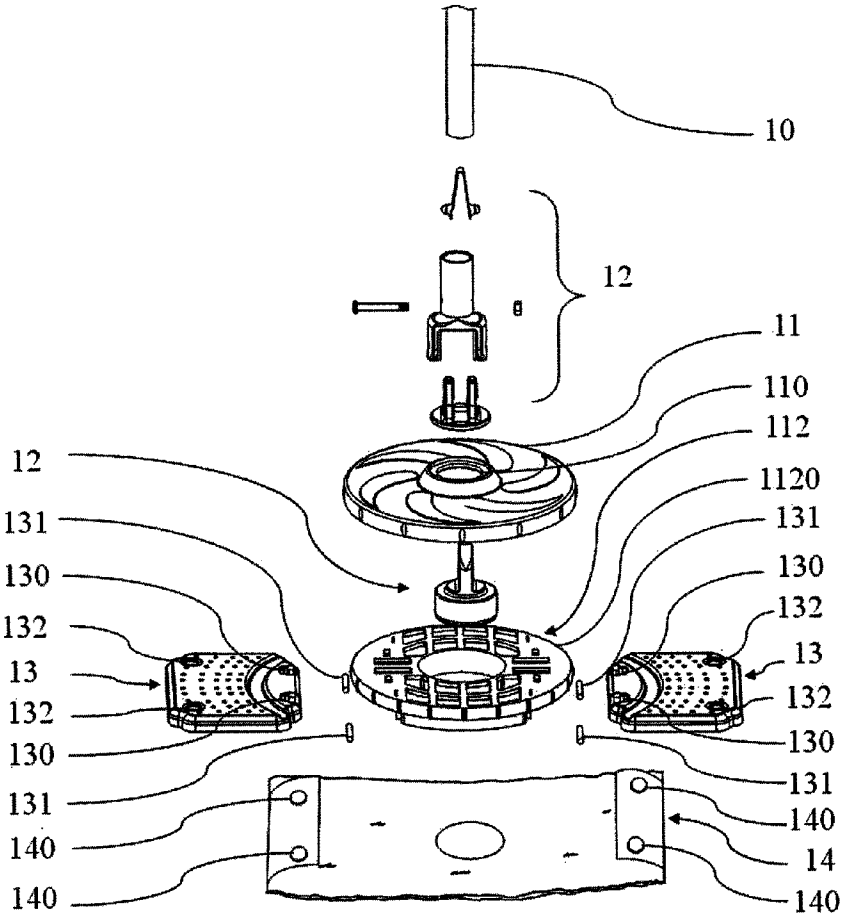
FIG. 2A is an exploded front view illustrating a second preferred embodiment of the present invention.
Figure 2B:
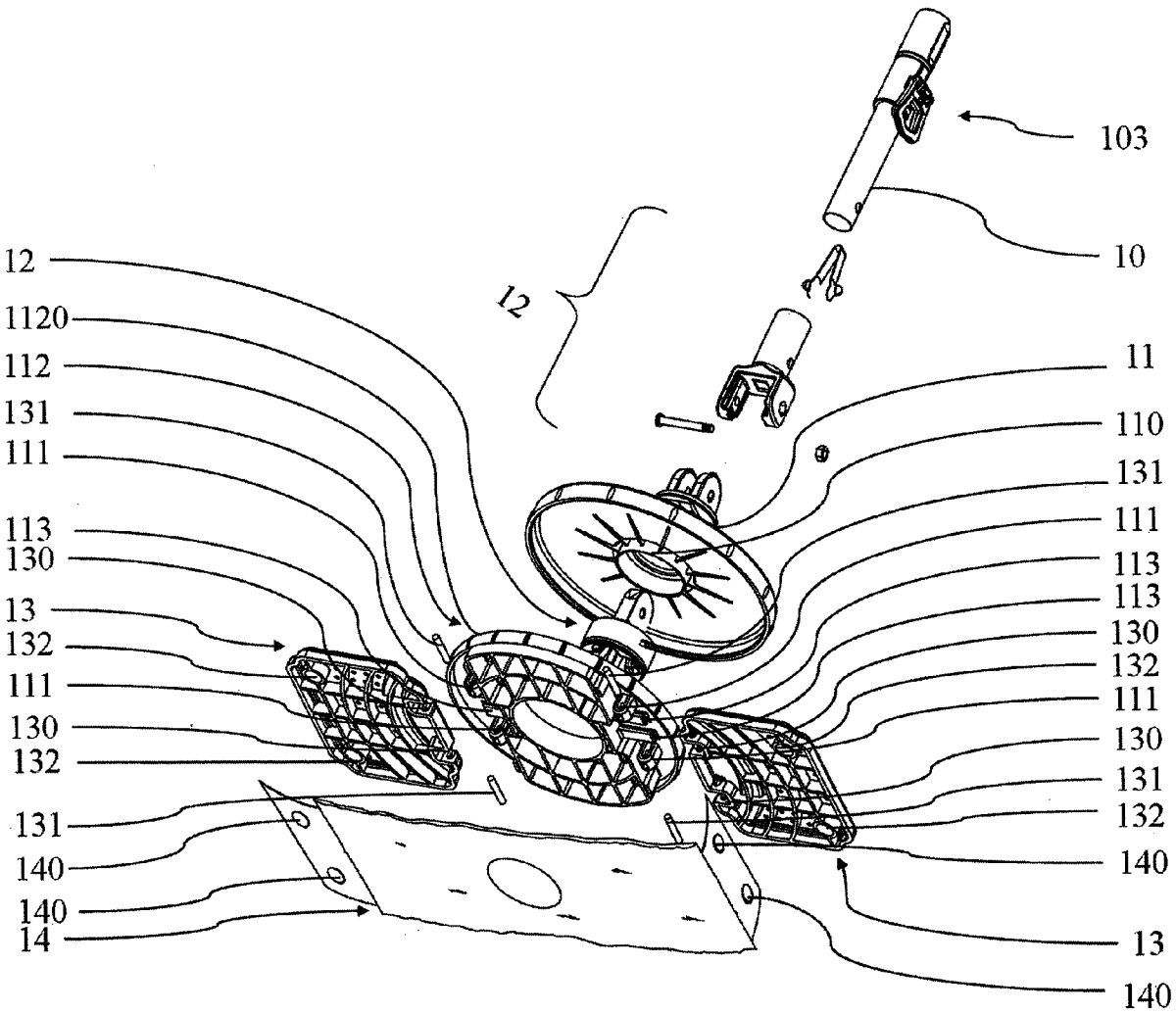
FIG. 2B is an exploded oblique view illustrating the second preferred embodiment of the present invention.
Figure 2C:
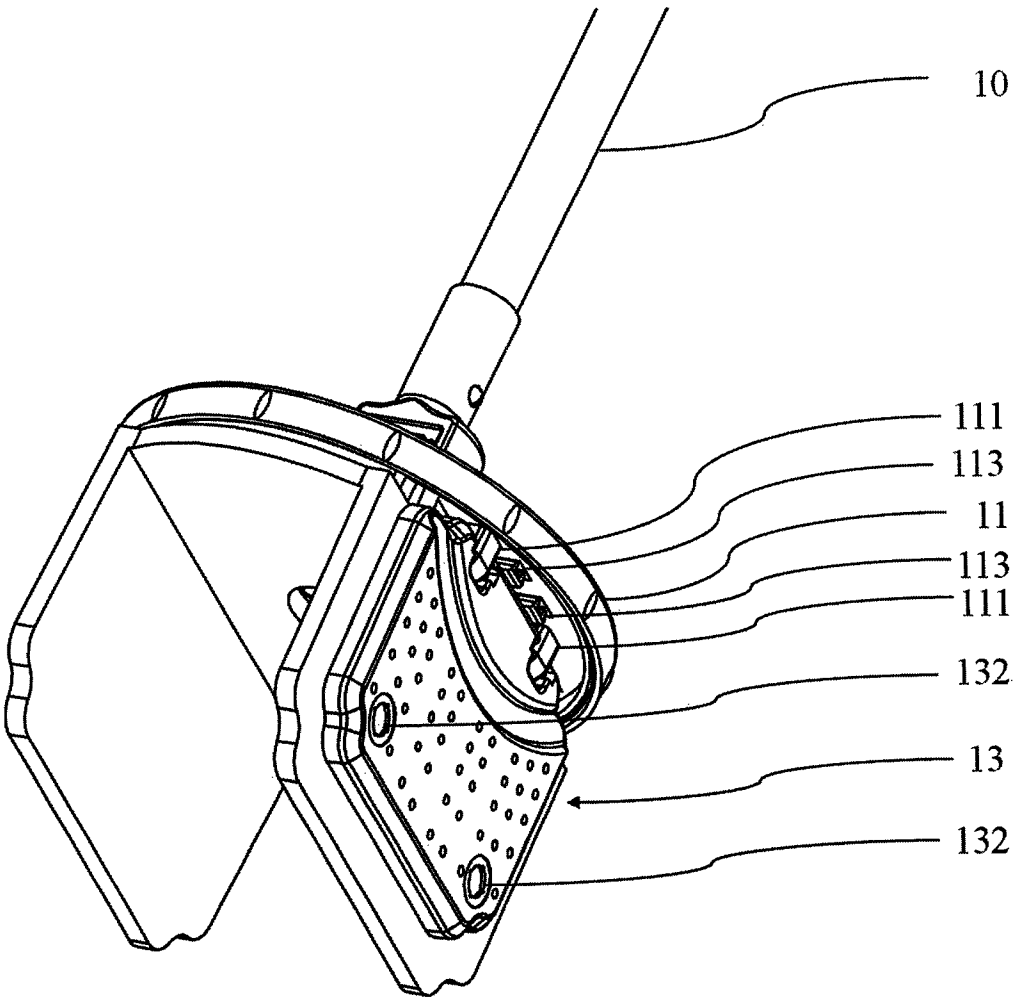
FIG. 2C is a schematic view illustrating bending of extending parts according to the second preferred embodiment of the present invention.
Figure 2D:
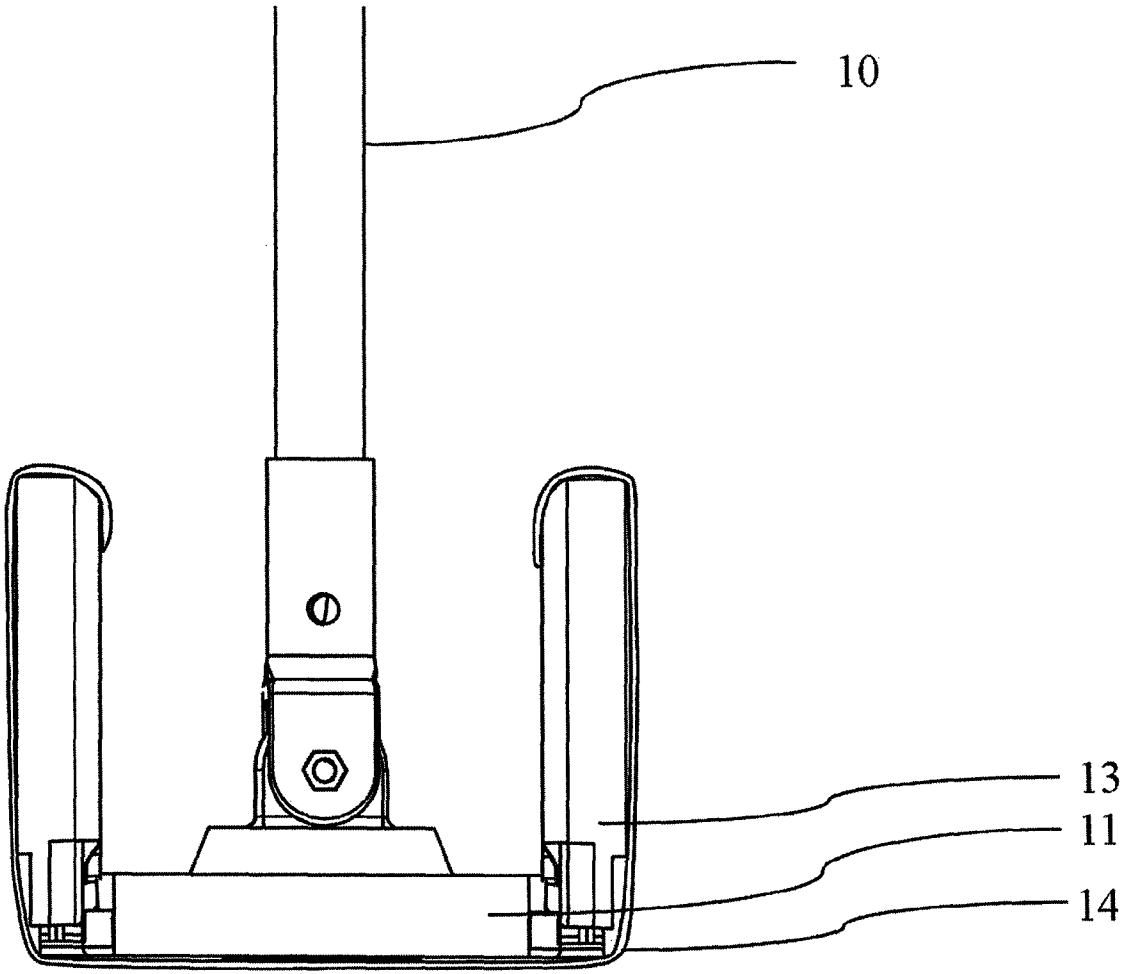
FIG. 2D is another schematic view illustrating bending of the extending parts according to the second preferred embodiment of the present invention.
Figure 2E:
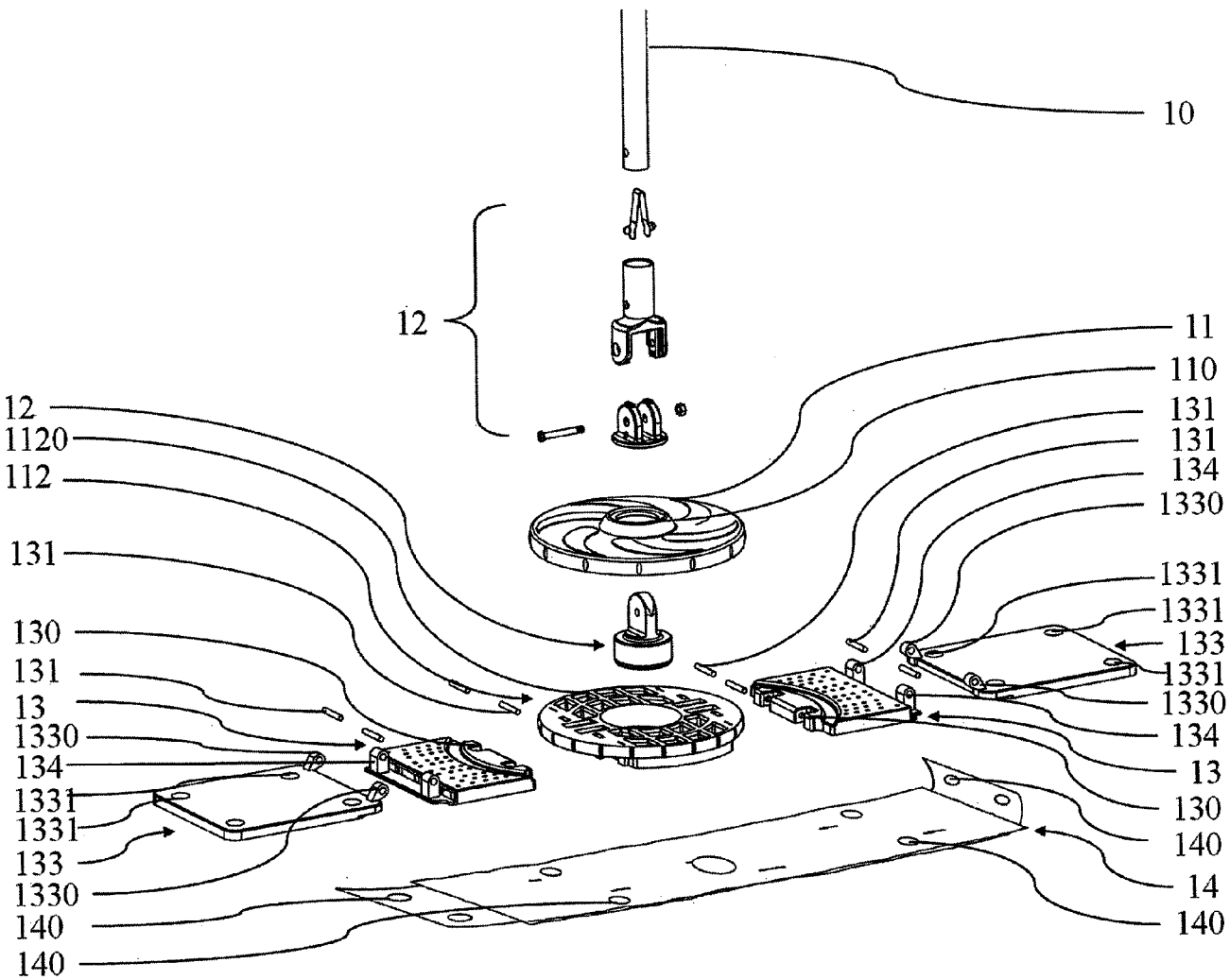
FIG. 2E is another exploded front view illustrating the second preferred embodiment of the present invention.

Referring to FIG. 2A, there is shown a mop structure according to a second preferred embodiment of the present invention. This embodiment mainly comprises a shaft body 10, a rotary disc 11 and a coupling assembly 12. The shaft body 10 can be held by a user with his hands to perform a cleaning operation. In this embodiment, the connection relationships between the shaft body 10 and the rotary disc 11 as well as the coupling assembly 12 are all the same as those in the first embodiment. It is to be noted that the rotary disc 11 can be further provided with a cleaning seat 112 that is detachable from the rotary disc 11 in this embodiment. The cleaning seat 112 comprises a joining disc 1120 and extending parts 13 extending from two ends of the joining disc 1120 respectively. The extending parts 13 are bendable vertically downwards or upwards with respect to the rotary disc 11. Each of the extending parts 13 further has at least one first connecting part 130, and the joining disc 1120 further has at least one second connecting part 111 (as shown in FIG. 2B), with the at least one first connecting part 130 of each of the extending parts 13 being disposed corresponding to the at least one second connecting part 111 of the joining disc 1120. Each of the extending parts 13 is pivoted to the rotary disc 11 via a pivot 131 by means of the at least one first connecting part 130 and the at least one second connecting part 111. A positioning strip 113 is further disposed near the at least one second connecting part 111, and there may be one or more positioning strips 113. The positioning strip 113 is used to position the extending parts 13 in a vertical or horizontal status when the extending parts 13 are bent vertically downwards or upwards or bent horizontally with respect to the rotary disc 11, so that the mop structure is more convenient for the user (referring to FIG. 2C and FIG. 2D). In addition, as shown in FIG. 2A and FIG. 2E, the extending parts 13 may also be coupled with elongated parts 133 respectively. The each of extending parts 13 have a third connecting part 134, and each of the elongated parts 133 further comprise a fourth connecting part 1330, with the third connecting parts 134 and the fourth connecting parts 1330 being disposed in one-to-one correspondence. The extending parts 13 are coupled to the elongated parts 133 by means of the third connecting parts 134 and the fourth connecting parts 1330 respectively. The rotary disc 11 has a rotary disc hole 110. The coupling assembly 12 is inserted through the rotary disc hole 110 and functions to connect the shaft body 10 with the rotary disc 11. This embodiment further comprises a cleaning appliance 14 disposed at bottom portions of the joining disc 1120, the extending parts 13 and the elongated parts 133. The cleaning appliance 14 has first joining parts 140, each of the extending parts 13 has a second joining part 132, and each of the elongated parts 133 has a third joining part 1331. By joining the first joining parts 140 with the second joining parts 132 and the third joining parts 1331, the cleaning appliance 14 can be assembled with the extending parts 13 and the elongated parts 133. The first joining parts 140 and the second joining parts 132 as well as the third joining parts 1331 may be designed as joining knobs and joining holes respectively, or may be joined with each other by means of a magic tape, and the present invention has no limitations herein. Further, the cleaning appliance 14 may have an elastically retractable band structure extending therefrom; and after the cleaning appliance 14 is joined with the extending parts 13 and the elongated parts 133, the extending parts 13 and the elongated parts 133 are bound by the elastically retractable band so that the cleaning appliance 14 is joined with the extending parts 13 and the elongated parts 133 more stably.

Figure 3:
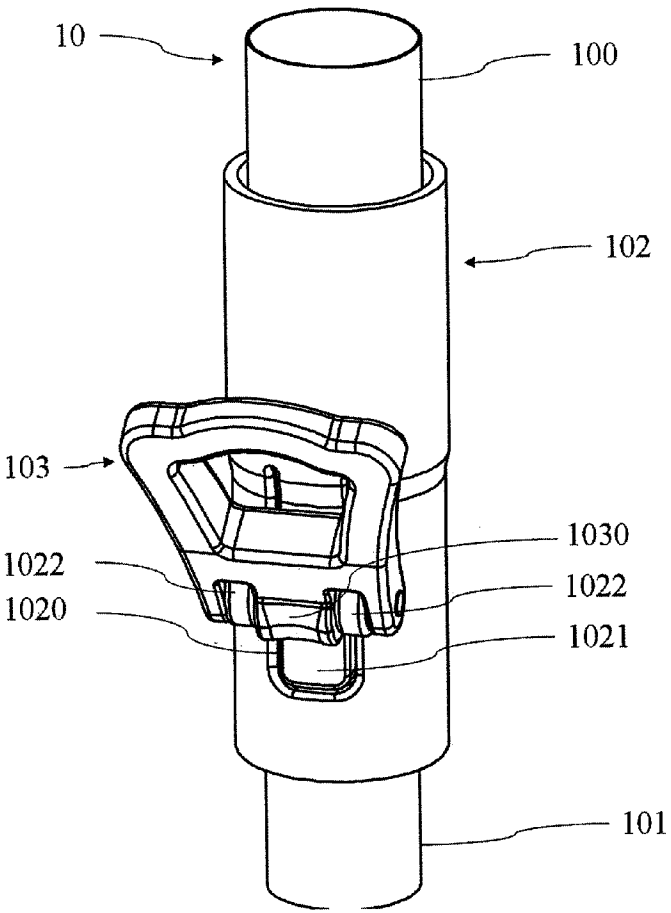
FIG. 3 is a perspective view illustrating a locking structure of a shaft body of the present invention.

Referring to FIG. 3, in the first embodiment and the second embodiment, the shaft body 10 may further comprise an inner shaft body 101, an outer shaft body 100 and a locking structure. The locking structure mainly comprises a bundle cover 102 and a wrench 103. An end of the inner shaft body 101 is fitted into the outer shaft body 100, and the bundle cover 102 is disposed at a position where the inner shaft body 101 is fitted into the outer shaft body 100. Meanwhile, a part of the bundle cover 102 is connected to the outer shaft body 100, and the other part of the bundle cover 102 covers a periphery of the inner shaft body 101. The bundle cover 102 is formed with a hole 1020, an elastic strip 1021 and block pivots 1022. The elastic strip 1021 extends into the hole 1020 from a side of the hole 1020, and the block pivots 1022 are disposed at two sides of the hole 1020 respectively. The wrench 103 is pivoted to the block pivots 1022, and has a bump 1030. The bump 1030 and the block pivots 1022 form an eccentric cam design. When the wrench 103 is rotated, the bump 1030 on the wrench 103 is rotated correspondingly to press against the elastic strip 1021 on the bundle cover 102, and the elastic strip 1021 then presses against the inner shaft body 101 to restrict the relative linear displacement between the inner shaft body 101 and the outer shaft body 100. In this way, the displacement of the inner shaft body 101 is restricted by the bump 1030 on the wrench 103, thereby achieving the locking purpose.

Figure 4:
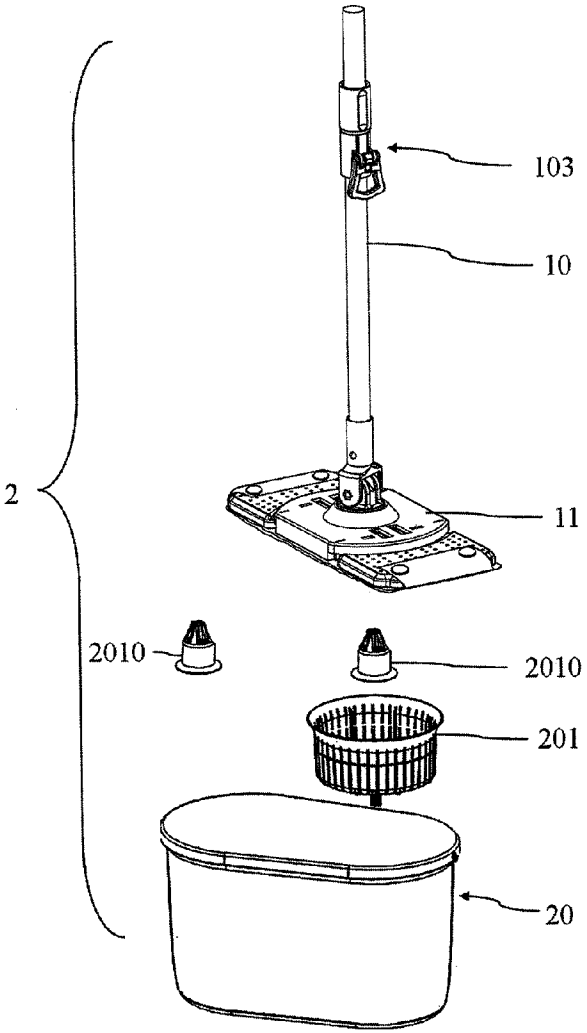
FIG. 4 is an exploded view illustrating a cleaning appliance set of the present invention.
Figure 5:
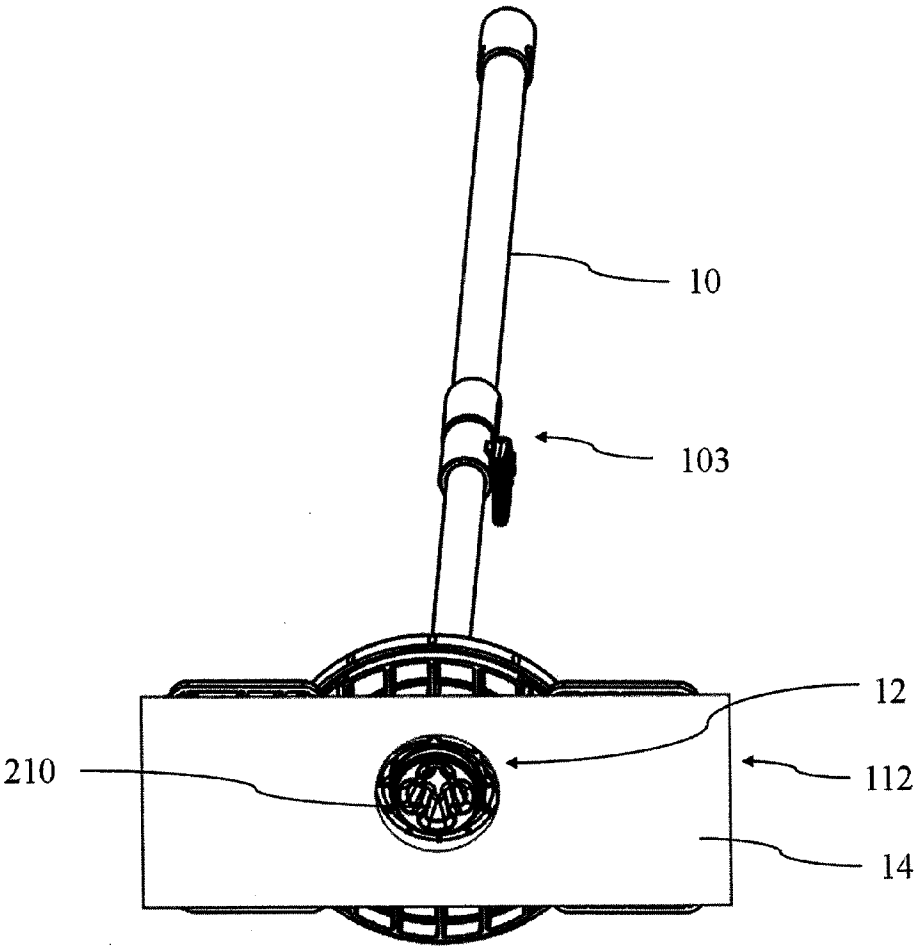
FIG. 5 is a perspective bottom view illustrating a mop of the present invention.
Figure 6:
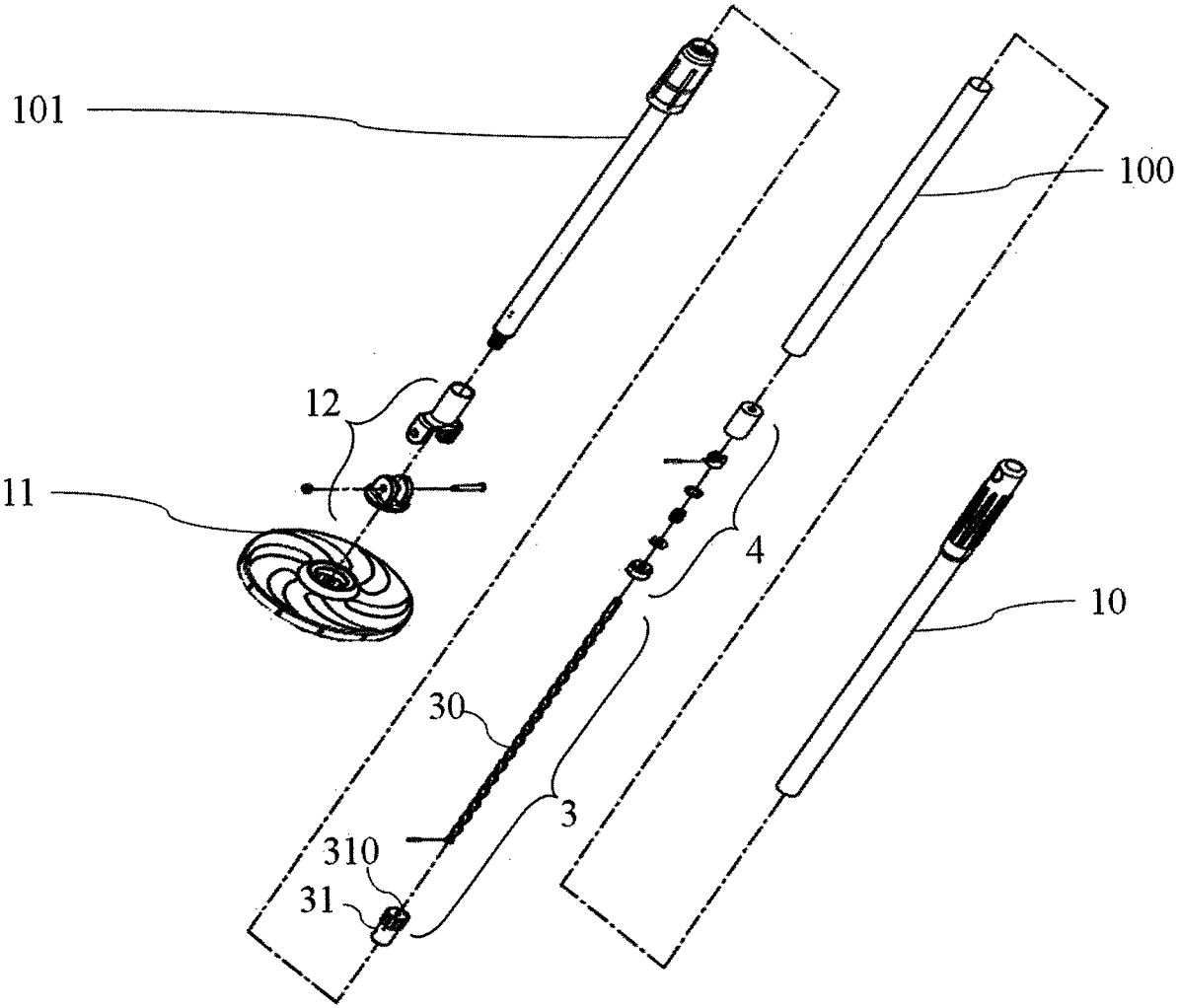
FIG. 6 is an exploded view illustrating a shaft body of the mop of the present invention.
Figure 7:
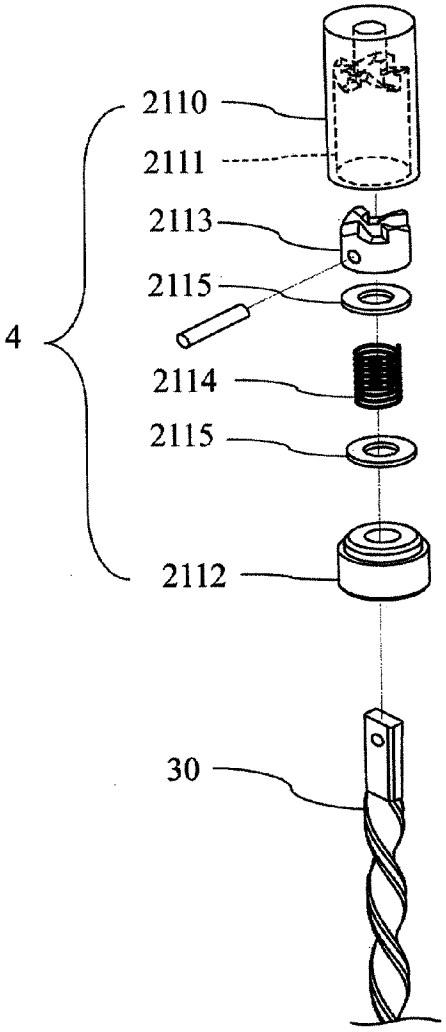
FIG. 7 is a perspective exploded view illustrating a clutch device of the present invention.

Meanwhile, referring to FIG. 4, in the first embodiment and the second embodiment, a dewatering tub 20 may be further provided to form a cleaning appliance set 2, and a first positioning part 210 (as shown in FIG. 5) can further provide at the bottom of the coupling assembly 12. Referring to FIG. 6 and FIG. 7, the shaft body 10 of the mop can be a rotary structure, and further comprises a screw 30 and a clutch device 4 in addition to the outer shaft body 100 and the inner shaft body 101. The clutch device 4 comprises a sleeve 2110, one-way crown teeth 2111, a pivoting joint 2112, a one-way crown gear 2113 and a spring 2114. The sleeve 2110 has an opening at an end thereof and a bottom at the other end thereof, and is disposed in the outer shaft body 100. The one-way crown teeth 2111 are disposed inside the sleeve 2110 at the bottom. The sleeve 2110 is fitted into the pivoting joint 2112 through the opening so that the sleeve 2110 can rotate on the pivoting joint 2112. The one-way crown gear 2113 is fitted into the interior of the sleeve 2110 so that the one-way crown gear 2113 and the one-way crown teeth 2111 are engaged with each other. Further, the spring 2114 is disposed between the one-way crown gear 2113 and the pivoting joint 2112. Furthermore, washers 2115 are disposed at ends of the spring

2114 that are connected to the one-way crown gear 2113 and the pivoting joint 2112 respectively. An end of the screw 30 passes through the pivoting joint 2112, the washers 2115 and the spring 2114 and is fixed with the one-way crown gear 2113.

Figure 8:
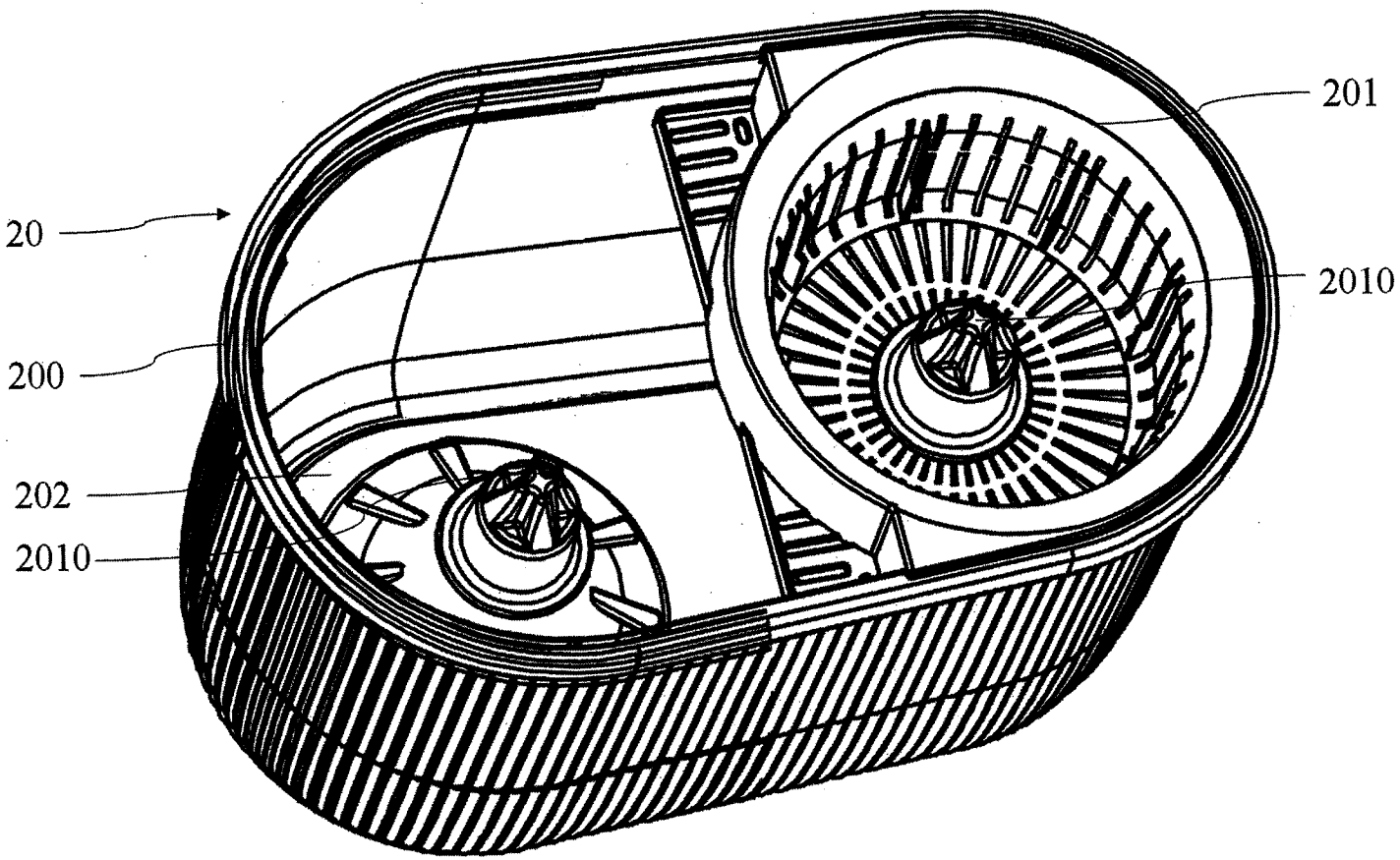
FIG. 8 is a perspective view illustrating a dewatering tub of the present invention.

Referring to FIG. 8, the dewatering tub 20 of the cleaning appliance set 2 has a tub body 200 and a dewatering basket 201, and the dewatering basket 201 may have a second positioning part 2010 disposed at a center thereof. In addition, the tub body 200 may have a cleaning part 202 at a bottom thereof, and the cleaning part 202 may also be provided with a second positioning part 2010. By assembling the first positioning part 210 of the mop and the second positioning part 2010 of the dewatering tub 20 with each other, the mop can be stably fixed with the dewatering basket 201 or the cleaning part 202 of the dewatering tub 20. In applications, the second positioning part 2010 may be designed to be detachable so that the second positioning part 2010 can be attached or detached as needed to enlarge the application scope of the dewatering tub 20.

Figure 9:
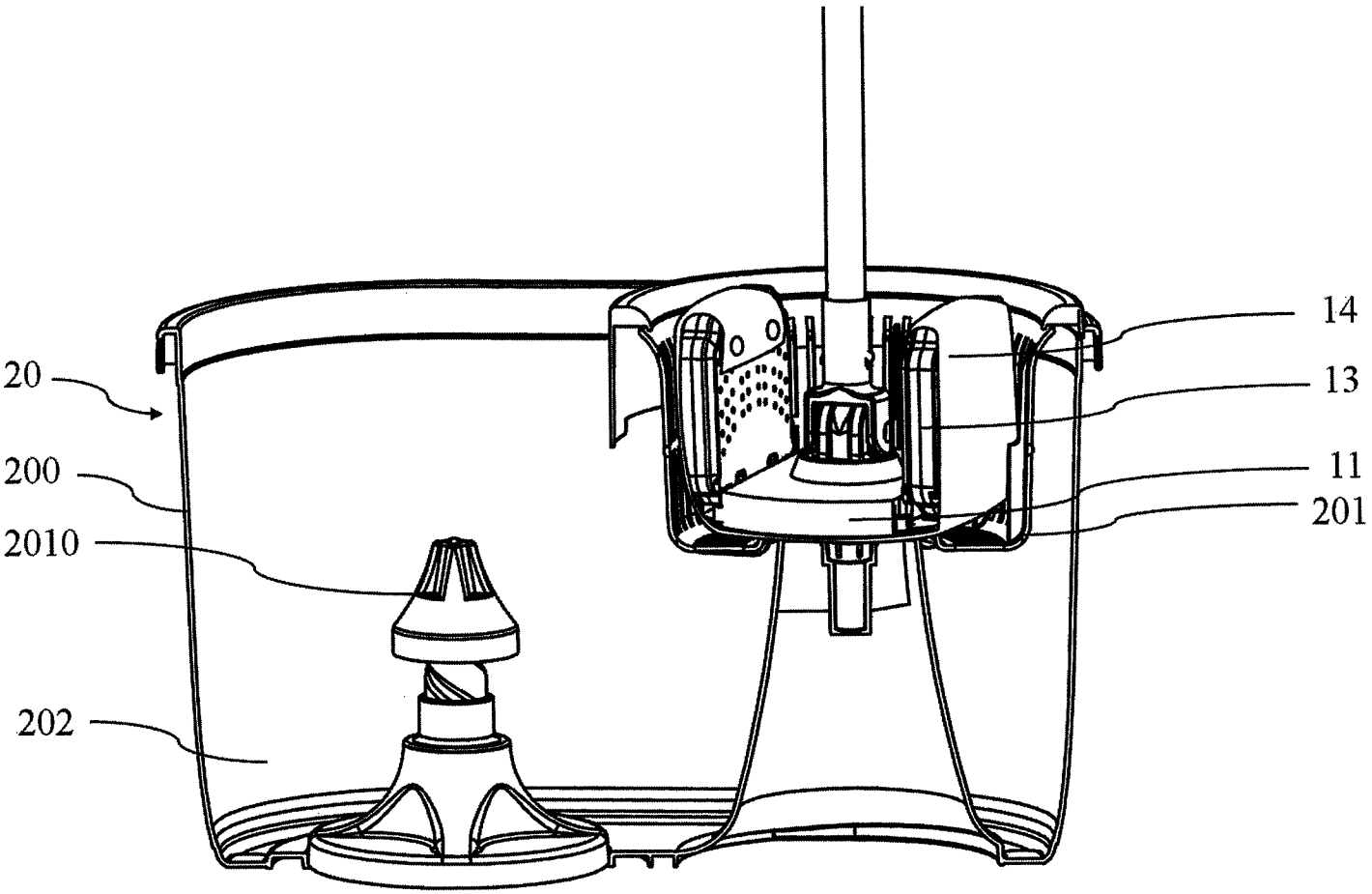
FIG. 9 is a schematic view illustrating dewatering of the mop of the present invention.
Figure 10:
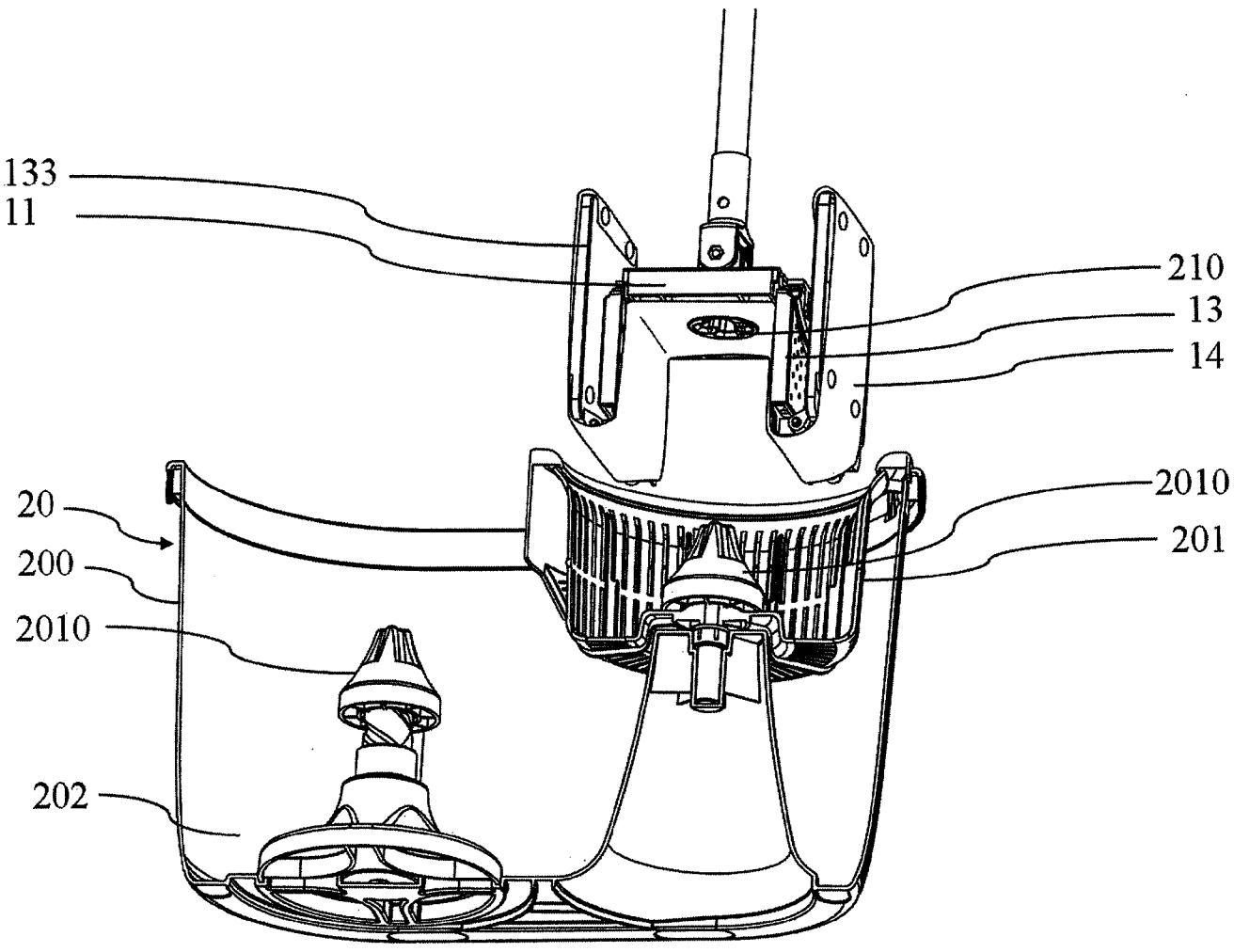
FIG. 10 is another schematic view illustrating dewatering of the mop of the present invention.

Referring to FIG. 9 and FIG. 10, when the user desires to clean and dewater the mop, the user can firstly bend the extending parts 13 upwards or bend the extending parts 13 downwards and the elongated parts 133 upwards, and then actuate the positioning strip 113 on the rotary disc 11 to position the extending parts 13 and the elongated parts 133 in a status perpendicular to the rotary disc 11 or the joining disc 1120. At the same time, clean water or a cleaning liquid can be injected into the tub body 200, and then the first positioning part 210 of the mop and the second positioning part 2010 of the cleaning part 202 of the tub body 200 are snap-fitted and joined with each other. Meanwhile, because the mop having the rotary structure is able to rotate, the user can have the mop rotate on the cleaning part 202 for cleaning purpose by manipulating the rotation of the mop after the first positioning part 210 and the second positioning part 2010 are joined. Then, after cleaning of the mop is completed, the first positioning part 210 of the mop and the second positioning part 2010 of the dewatering basket 201 in the dewatering tub 20 are joined closely. At this point, both the extending parts 13 and the cleaning appliance 14 or both the elongated parts 133 and the cleaning appliance 14 can be exactly attached to a wall surface around the dewatering basket 201. Likewise, by means of the rotary structure of the mop, the mop is dewatered through rotation in the dewatering basket 201. After the dewatering operation is completed, the extending parts 13 or the elongated parts 133 of the mop are bent towards a horizontal direction and then positioned by means of the positioning strip 113 on the rotary disc 11 so that the extending parts 13 or the elongated parts 133 keep flat with the rotary disc 11 or the joining disc 1120, which is favorable for the user to use the mop for cleaning purpose.

Figure 11:
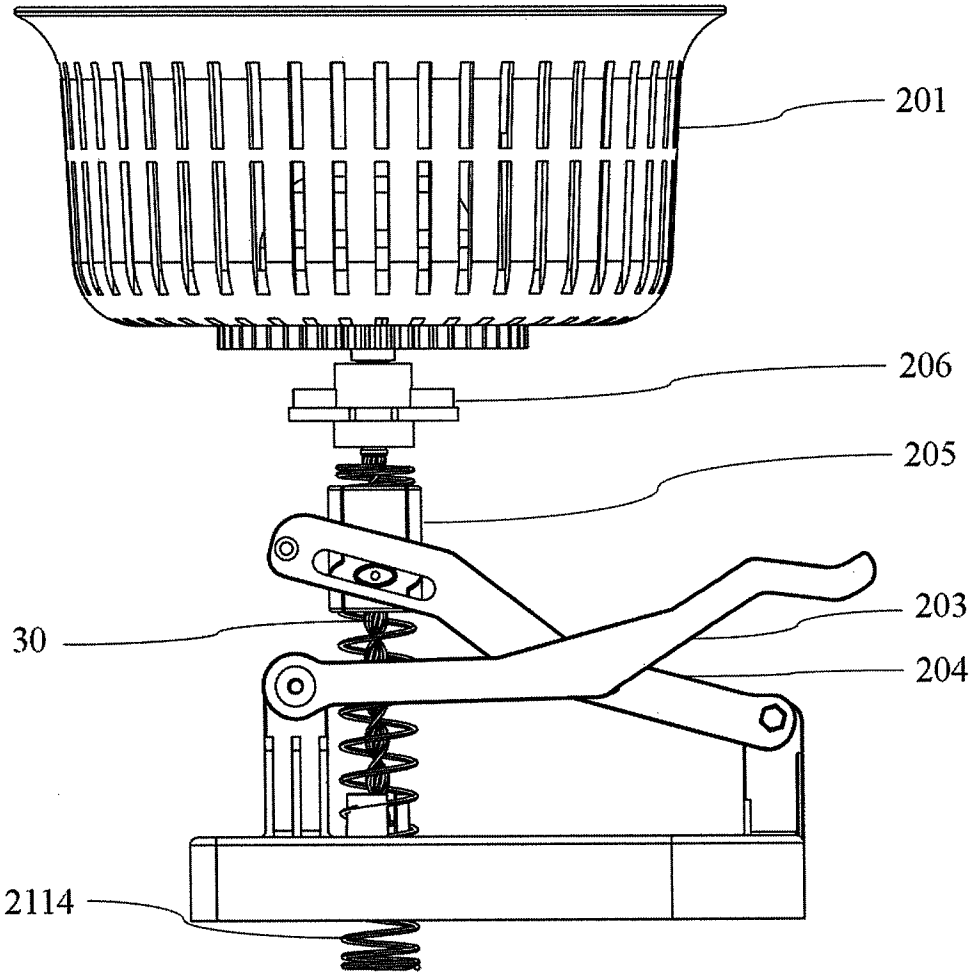
FIG. 11 is a perspective view illustrating a pedal-driven dewatering basket of the present invention.

Furthermore, dewatering through rotation of the dewatering basket may be accomplished in two ways, i.e., a down-pressing way and a pedal driving way. Referring to FIG. 6 and FIG. 8, the down-pressing way of dewatering is as follows: after the mop is placed properly in the dewatering basket 201, the user can press the shaft body 10 of the mop downwards; and by means of the rotary structure of the mop, the dewatering basket 201 in the dewatering tub 20 is driven by the mop to rotate, thereby further achieving the effect of dewatering the mop by means of a centrifugal force. Referring to FIG. 6 and FIG. 11, the structure of the dewatering basket 201 operating in the pedal driving is different from that of operating in the down-pressing way. The pedal-driven dewatering tub 20 may comprise a pedal 203, a pressure plate 204, a worm gear 205 and a one-way bearing 206. When the user desires to have the mop dewatered through rotation, the user can place the mop into the dewatering basket 201 of the dewatering tub 20, and then treads on the pedal 203 with a foot. When the pedal 203 is trod down, the pedal 203 presses the pressure plate 204 downwards, and the pressure plate 204 then drives the worm gear 205 to move the screw 30 downwards so that the screw 30 rotates to drive the one-way bearing 206, thereby rotating the dewatering basket 201. Then, when the user moves his foot away from the pedal 203, the spring 2114 in the structure of the pedal-driven dewatering tub 20 pushes the worm gear 205 upwards, the worm gear 205 then pushes the pressure plate 204 and the pedal 203 to the original positions thereof, and the dewatering basket 201 maintains inertia rotation by means of the one-way bearing 206. When the cleaning appliance 14 rotates, water attached to the cleaning appliance 14 is removed within the dewatering basket 201, and the cleaning appliance 14 then becomes suitable for wiping a floor.

Therefore, according to the mop structure of the present utility model, the efficacy of bending and dewatering the flat mop can be achieved through simple operations, and the mop is simple in structure and requires use of only simple components. This not only reduces the material cost and the manufacturing cost, but also makes the manufacturing and assembling processes convenient. According to the above descriptions of the structure and the operations of the present invention, the mop structure has a humanized operation interface and can be used by the user naturally, quickly and conveniently, so the mop structure is convenient to use and is of great utility. Moreover, because the present invention has simple structure and components, the material cost and the manufacturing cost are further reduced, which significantly reduces the expenses necessary for the manufacturing process.

What described above are only preferred embodiments of the present invention but are not intended to limit the scope of the present utility model. Accordingly, as will be appreciated by those of ordinary skill in the art, any equivalent structural or process flow modifications that are made without departing from the spirits of the present invention shall also fall within the scope of the present invention.

What is claimed is:

1. A mop structure, comprising:

a shaft body (10);

a rotary disc (11) having a rotary disc hole (110); and a coupling assembly (12) inserted through the rotary disc hole (110) and connecting the shaft body (10) with the rotary disc (11), wherein:

the rotary disc (11) is further provided with a cleaning seat (112), the cleaning seat (112) comprises a joining disc (1120) and extending parts (13) extending from two ends of the joining disc (1120) respectively, and the extending parts (13) are bendable with respect to the joining disc (1120).

2. The mop structure of claim 1, wherein each of the extending parts (13) further has at least one first connecting part (130), the joining disc (1120) further has at least one second connecting part (111) disposed corresponding to the at least one first connecting part (130), and the extending parts (13) are pivoted to the rotary disc (11) by means of a pivot (131).

3. The mop structure claim 2, wherein the rotary disc (11) is further provided with at least one positioning strip (113) at the bottom thereof near the at least one second connecting part (111).

4. The mop structure of claim 1, further comprising a pair of elongated parts (133) coupled with the extending parts (13) respectively.

5. The mop structure of claim 4, wherein each of the extending parts (13) has a third connecting part (134), each of the elongated parts (133) further comprises a fourth connecting part (1330), the third connecting parts (134) and the fourth connecting parts (1330) are disposed in one-to-one correspondence, and the extending parts (13) are coupled to the elongated parts (133) by means of the third connecting parts (134) and the fourth connecting parts (1330) respectively.

6. The mop structure of claim 4, further comprising a cleaning appliance (14) disposed at bottom portions of the joining disc (1120), the extending parts (13) and the elongated parts (133).

7. The mop structure of claim 6, wherein the cleaning appliance (14) has first joining parts (140), each of the extending parts (13) has a second joining part (132), and the first joining parts (140) and the second joining parts (132) are joined with each other.

8. The mop structure of claim 6, wherein the cleaning appliance (14) has first joining parts (140), each of the elongated parts (133) has a third joining part (1331), and the first joining parts (140) and the third joining parts (1331) are joined with each other.

* * * * *